US006248034B1

(12) United States Patent
Voloshen

(10) Patent No.: US 6,248,034 B1
(45) Date of Patent: Jun. 19, 2001

(54) STREET HOCKEY PUCK

(76) Inventor: Gregory J. Voloshen, 11820 Edgewater Dr., Suite 123, Lakewood, OH (US) 44107

( * ) Notice: Subject to any disclaimer, the term of this patent is extended or adjusted under 35 U.S.C. 154(b) by 0 days.

(21) Appl. No.: 09/362,382

(22) Filed: Jul. 28, 1999

Related U.S. Application Data

(60) Provisional application No. 60/094,427, filed on Jul. 28, 1998.

(51) Int. Cl.[7] ..... A63B 71/00
(52) U.S. Cl. ..... 473/588; 473/589
(58) Field of Search ..... 473/587, 588, 473/589

(56) References Cited

U.S. PATENT DOCUMENTS

| | | | |
|---|---|---|---|
| 3,675,928 | 7/1972 | Gentile . | |
| 5,149,096 | 9/1992 | Keating et al. . | |
| 5,269,520 | 12/1993 | Vellines . | |
| 5,275,410 | 1/1994 | Bellehumeur et al. . | |
| 5,518,238 | 5/1996 | Hu et al. . | |
| 5,531,442 | 7/1996 | Gill . | |
| 5,695,420 * | 12/1997 | Bellehumeur | 473/588 |
| 5,697,858 * | 12/1997 | Lekavich | 473/588 |
| 5,733,213 * | 3/1998 | Colarusso | 473/588 |
| 5,855,528 | 1/1999 | Aiello et al. . | |

* cited by examiner

*Primary Examiner*—Raleigh W. Chiu
(74) *Attorney, Agent, or Firm*—Fay, Sharpe, Fagan, Minnich & McKee, LLP

(57) ABSTRACT

A street hockey puck (100) includes a main body (110) having opposing top and bottom sides (116, 118) and an outer periphery. A plurality of skid assemblies (200) are disposed around the outer periphery of the main body (110). The skid assemblies (200) each include opposing first and second skids (210, 212) having profiles that sit proud of the top and bottom sides (116, 118) of the main body (110), respectively. The first and second skids (210, 212) each include a pin (220) and a pin receiving recess (224). The pin (220) extends longitudinally through the main body (110), and has a distal end and a proximal end. The pin receiving recess (224) of the first skid (210) receives therein the distal end of the pin (220) extending from the second skid (212), and the pin receiving recess (224) of the second skid (212) receives therein the distal end of the pin (220) extending from the first skid (210).

20 Claims, 6 Drawing Sheets

STREET HOCKEY PUCK

This application claims the benefit of U.S. Provisional Application No. 60/094,427, filed Jul. 28, 1998.

BACKGROUND OF THE INVENTION

The present invention relates to hockey pucks. It finds particular application in conjunction with street or roller hockey pucks, and will be described with particular reference thereto. However, it is to be appreciated that the present invention is also amenable to other like applications.

In recent years the sport of street or roller hockey has increased in popularity due to the advent of the roller blade or in-line skate. The skate itself feels more like an ice skate then a roller skate. Likewise, for street hockey, a puck is desired which travels and/or otherwise performs on asphalt, concrete, or other like playing surface as if it were on ice, i.e., gliding or sliding smoothly.

Typically, in street hockey, the playing surface is rough, unlike ice hockey where you have a lower coefficient of friction. These rough playing surfaces tend to cause conventional pucks to act erratically forcing the puck to flip and/or roll on its outer edge. These are undesirable results.

There have been pucks designed to address the problem of puck performance. While some of the prior designs have worked better than others, all of the previously designed pucks have, due to their hardness and/or inflexibility, a tendency to injure players or spectators when struck therewith. A rigid or hard puck is unable to sufficiently absorb the shock upon impact with a player and/or spectator. Accordingly, a large portion of the force upon impact is delivered to the individual struck.

In addition to being constructed of hard polymers, several pucks employ rolling parts such as wheels, spheres, ball bearing, etc. on which the puck travels over the playing surface. These rolling features change the nature of the puck's performance or play from gliding or sliding across the playing surface to rolling across the playing surface thereby reducing the ice hockey feel. Moreover, a common problem associated with these designs is that the wheels or rolling parts are jammed or clogged during play by debris getting caught between the rolling parts and the body of the puck. When this happens, the puck no longer travels across the playing surface freely.

Other previous puck designs employ skids or runners on which the pucks are able to glide or slide across the playing surface. With reference to FIGS. 1A through 1C, a prior art skid assembly 10 for use with a street hockey puck is shown. It includes a top skid 10*a* and a bottom skid 1*b* which sit proud of a top surface 20*a* and a bottom surface 2*b* of a main body 20. Typically, the main body 20 is cylindrical in form and a plurality of skid assemblies 10 are installed around it's circumference at it's periphery. As best seen in FIGS. 1B and 1C, the skid assemblies 10 are installed via opposing solid pins 12 and hollow pin-receiving housings 14 which are integral with the skids 10*a* and 10*b* and that extend longitudinally through the main body 20.

As shown in FIG. 1C, these types of skid assemblies 10 are not optimal insomuch as the relatively thin walls of the hollow pin-receiving housings 14 tend to develop cracks 16 under the extreme impacts experienced by the puck during play. Additionally, during it's use, the skids 10*a* and 10*b* on the puck wear down through repeated sliding contact and friction with the playing surface. In these pucks, there is no way to readily measure the amount of wear on the skids 10*a* and 10*b,* or determine when a skid should be replaced.

Accordingly, play tends to continue with a puck having overly worn skids that are less than optimal. Such worn skids in turn allow the body 20 of the puck to more readily catch on the playing surface causing the puck to flip and/or lose momentum.

The present invention contemplates a new and improved street hockey puck which overcomes the above-referenced problems and others.

SUMMARY OF THE INVENTION

In accordance with one aspect of the present invention, a street hockey puck includes a main body having opposing top and bottom sides and an outer periphery. A plurality of skid assemblies are disposed around the outer periphery of the main body. The skid assemblies each include opposing first and second skids having profiles that sit proud of the top and bottom sides of the main body, respectively. The first and second skids each include a pin and a pin receiving recess. The pin extends longitudinally through the main body, and has a distal end and a proximal end. The pin receiving recess of the first skid receives therein the distal end of the pin extending from the second skid, and the pin receiving recess of the second skid receives therein the distal end of the pin extending from the first skid.

In accordance with another aspect of the present invention, a street hockey puck includes a main body having opposing top and bottom sides and an outer periphery. A plurality of skid assemblies are disposed around the outer periphery of the main body. The skid assemblies each include opposing first and second skids having profiles that sit proud of the top and bottom sides of the main body, respectively. The profiles include ridges which, with use, wear flush with a gap therebetween.

In accordance with another aspect of the present invention, a street hockey puck includes a main body having opposing top and bottom sides. The main body includes a cylindrical center hub and a deformable annular outer ring which is concentric with the cylindrical center hub. A plurality of skids assemblies, upon which the street hockey puck rides as it traverses a planar playing surface, are disposed around the deformable annular outer ring. A plurality of shock absorbing mechanical linkages connect the deformable annular outer ring to the cylindrical center hub. The mechanical linkages are disposed angularly about the cylindrical center hub.

One advantage of the present invention is that it's flexibility makes it safer when impacting a player or other individual.

Another advantage of the present invention is it's improved performance with play mimicking the gliding or sliding ice hockey feel.

Yet another advantage of the present invention is the durability of the skid assemblies.

Another advantage of the present invention is that wear on the skids is readily determinable from a simple observation.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention.

DETAILED DESCRIPTION OF THE PREFERRED EMBODIMENTS

Figure 1A:
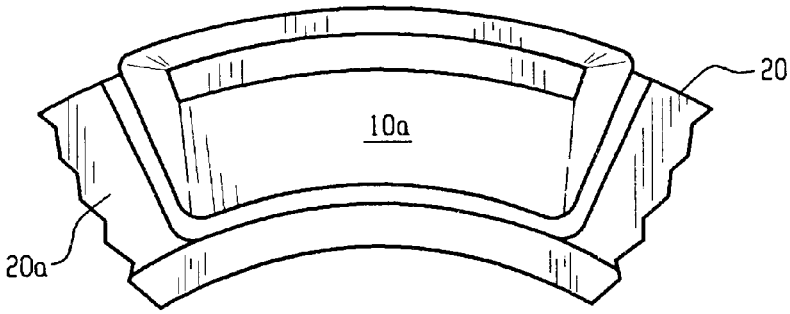
Fig. 1A PRIOR ART
FIG. 1A is a partial top view of a prior art street hockey puck with a skid assembly installed therein.
Figure 1B:
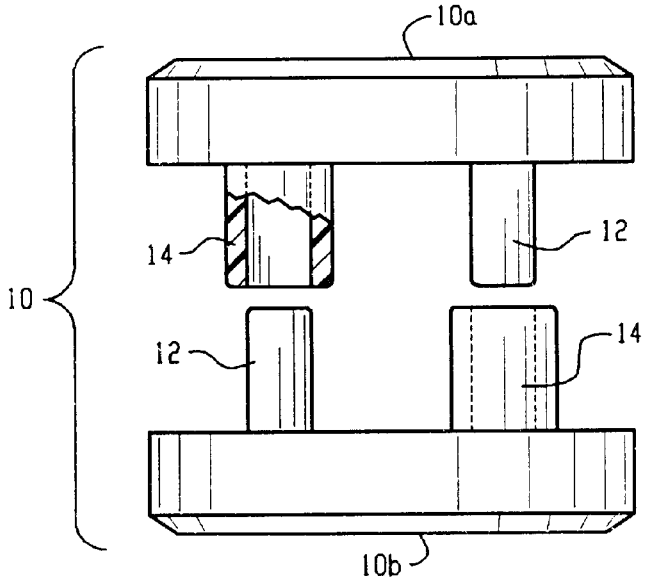
Fig. 1B PRIOR ART
FIG. 1B is a side elevation view of the prior art skid assembly as shown in FIG. 1A, wherein the skid assembly is uninstalled and blown apart.
Figure 1C:
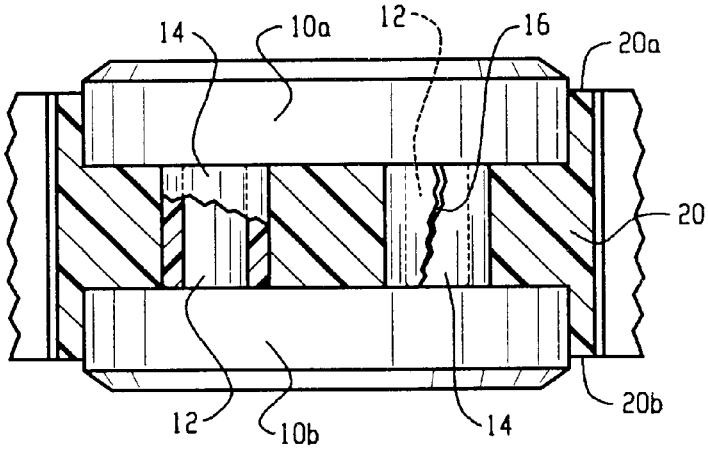
Fig. 1C PRIOR ART
FIG. 1C is a partial side view of the prior art street hockey puck shown in FIG. 1A.
Figure 2A:
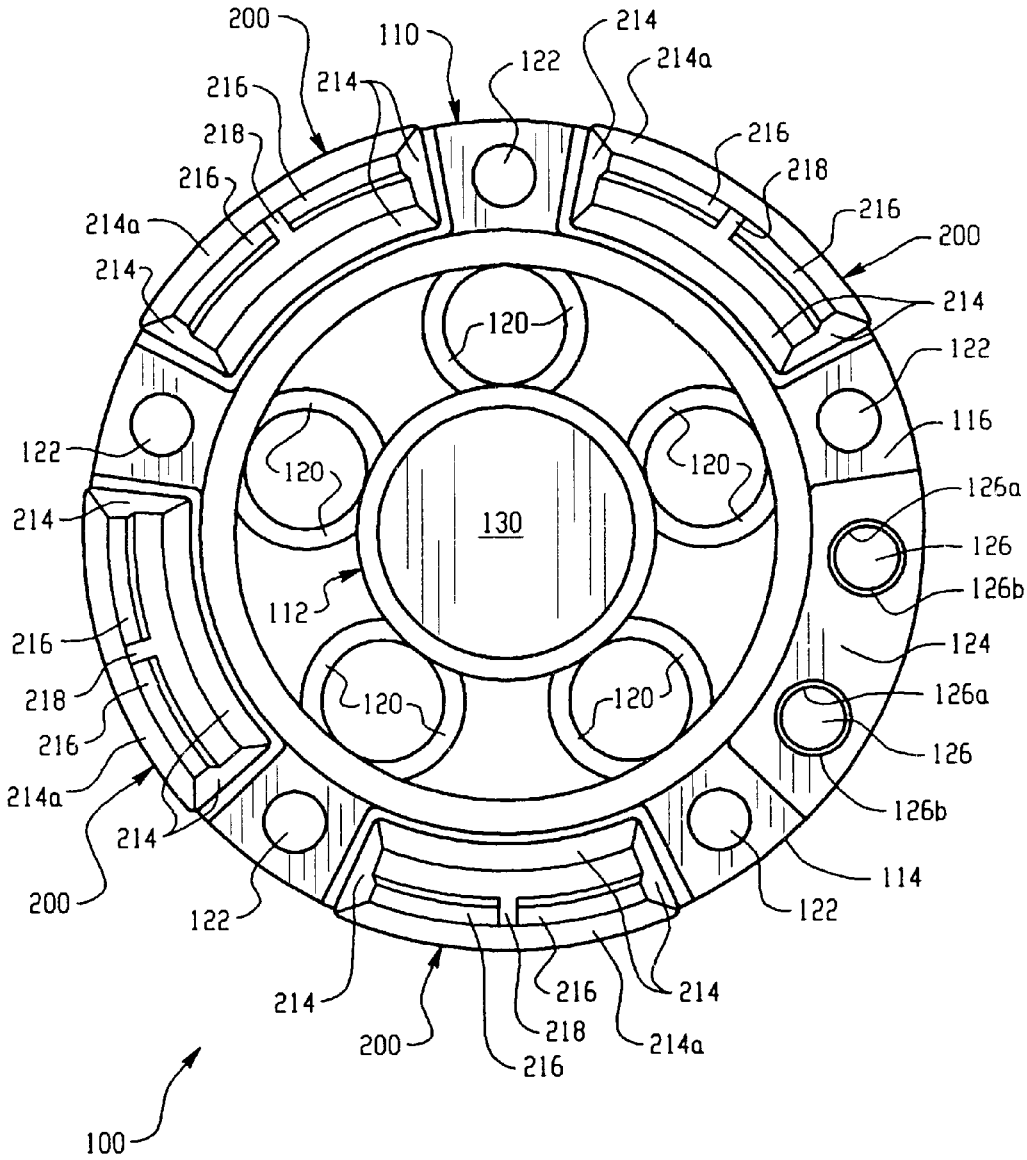
FIG. 2A is a top plan view of a street hockey puck in accordance with aspects of the present invention with one skid assembly removed therefrom for illustrative purposes herein.
Figure 2B:
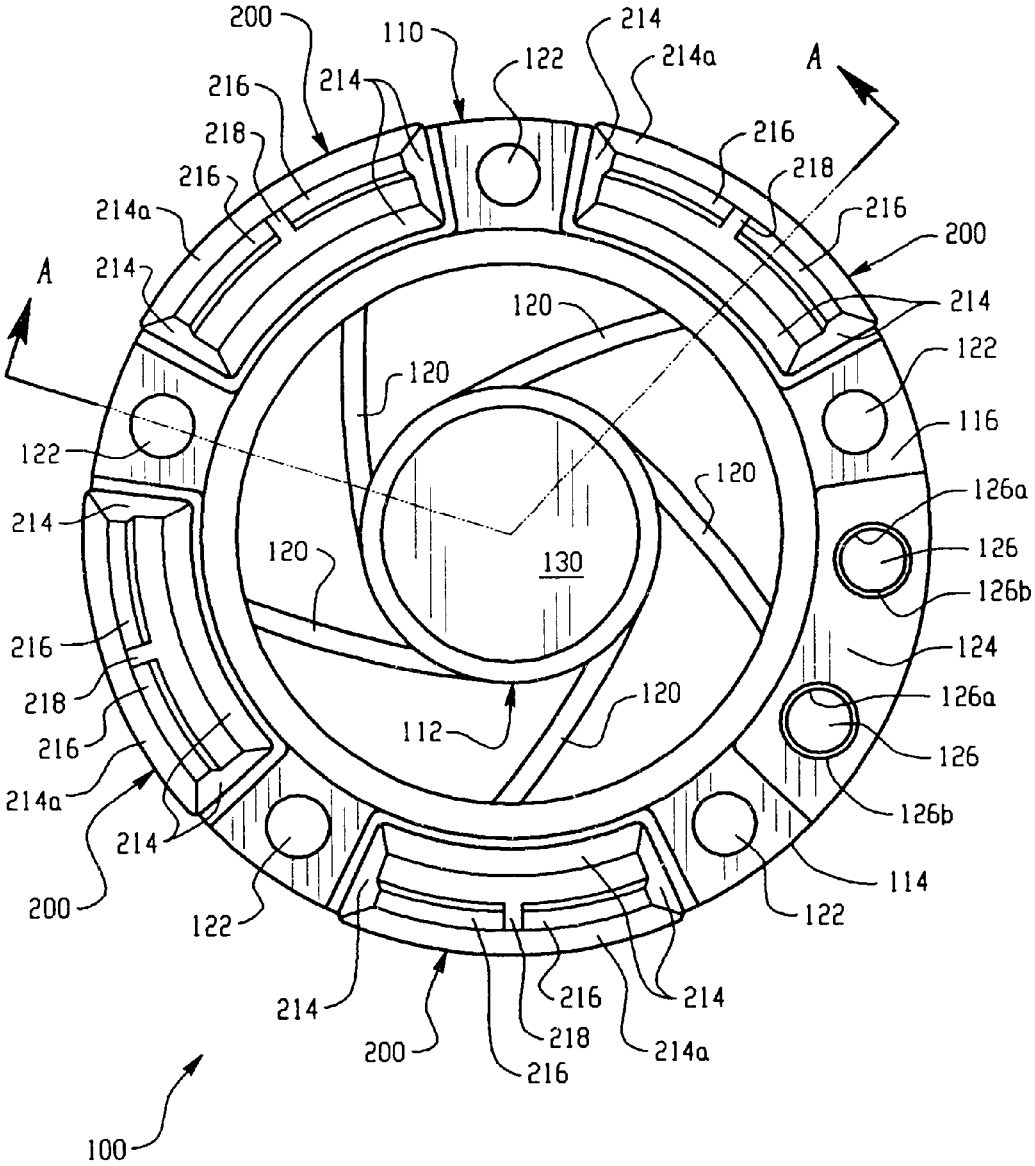
FIG. 2B is a top plan view of a street hockey puck in accordance with aspects of the present invention with one skid assembly removed therefrom for illustrative purposes herein.

With reference to FIGS. 2A and 2B, a street hockey puck 100 includes a main body 110 having a cylindrical center hub 112 and a deformable annular outer ring 114 which is concentric with the hub 112. The main body 110 also has a top surface or side 116 and a bottom surface or side 118, as better seen in later FIGURES (e.g., FIG. 3). The main body 110 also includes a plurality of shock absorbing mechanical linkages 120 connecting the deformable annular outer ring 114 to the center hub 112. The mechanical linkages 120 are disposed angularly about the center hub 112, preferably at equal intervals to promote uniformity in performance and shock absorption or distribution. In a preferred embodiment, the main body 110 is integrally molded or otherwise formed from a soft and flexible but resilient material, such as a rubber, plastic, satoprene, or other suitable composite material.

With particular reference to FIG. 2A, the shock absorbing mechanical linkages 120 are collapsible hollow cylindrical members connecting the deformable annular outer ring 114 to the cylindrical center hub 112. In a preferred embodiment, as illustrated, five linkages 120 are employed. Alternately, they can be view as a plurality of adjacent arcing members have opposing directions of curvature (e.g., as shown there are 10 such arcing members). In the later case, the arcing members have a radius of curvature less than the hub 112. However viewed, a notable feature of the embodiment illustrated in FIG. 2A is that due to the symmetrical nature of the mechanical linkages 120, the hockey puck 100 has a more uniform reaction regardless of the direction (i.e., clockwise or counterclockwise) of a torque applied thereto by, e.g., a hockey stick.

With particular reference to FIG. 2B, in another preferred embodiment, the mechanical linkages 120 include a plurality of flexible arcing members which all have the same direction of curvature (e.g., as shown there are 5 such arcing members). In this embodiment, each linkage 120 includes a single arcing member having a radius of curvature greater than the hub 112.

In any event, when the street hockey puck 100 strikes a player or other individual, the annular outer ring 114 deforms and the mechanical linkages 120 collapse or otherwise flex to absorb the force of the impact. Accordingly, the amount of force transferred to the individual struck is lessened and the potential for injury reduced. Additionally, in this manner, the street hockey puck 100 absorbs or cushions bumps from rough playing surfaces, such as asphalt, concrete, and the like, thus increasing the likelihood of the street hockey puck 100 maintaining a flat orientation with respect to the planar playing surface as it slides across the same. That is to say, by absorbing or cushioning the bumps there is less chance of the hockey puck 100 catching or snagging on a crack or bump and flipping up on its end. Furthermore, the resilience of the mechanical linkages 120 and material used to construct the main body 110 enhances rebounds off a rink's sideboards, hockey sticks, etc. In alternate embodiments, the number of mechanical linkages 120 are varied and the material for the main body 110 selected to achieve a desired combination of flexibility, firmness, and resilience.

To relieve stress in the annular outer ring 114 when it undergoes deformation, and to further promote the desired flexibility and resilience of the street hockey puck 100, in a preferred embodiment, a plurality of bores or relief holes 122 are created in the annular outer ring 114 extending longitudinally from the top side 116 to the bottom side 118 of the main body 110. For uniformity of performance, preferably, the relief holes 122 are dispersed angularly about the annular outer ring 114 at equal intervals. In a preferred embodiment, 5 relief holes 122 are employed to achieve the desired performance. However, in alternate embodiments, the number of relief holes 122 is optionally more or less. Additionally, as shown in FIG. 2A, the relief holes 122 coincide with the angular sites of connection of the annular outer ring 114 with the mechanical linkages 120. Alternately, as shown in FIG. 2B, the relief holes 122 are spaced equally between the angular sites of connection of the annular outer ring 114 with the mechanical linkages 120. In this manner, flexibility and resilience is optimized while promoting an even deformation and recoil.

In an alternate embodiment, one of the relief holes 122 is used as a point of attachment for a key chain, string, cord or like strand. In this manner then the street hocky puck 100 serves as a keepsake or souvenir which is optionally suspended from the strand for display or other purposes. Moreover, the strand is optionally used to holds keys, an instruction card, or a standard, placard, emblem, token, or like tag having indicia, such as, e.g., a team, company, or like logo or name, printed or otherwise depicted thereon.

Figure 3:
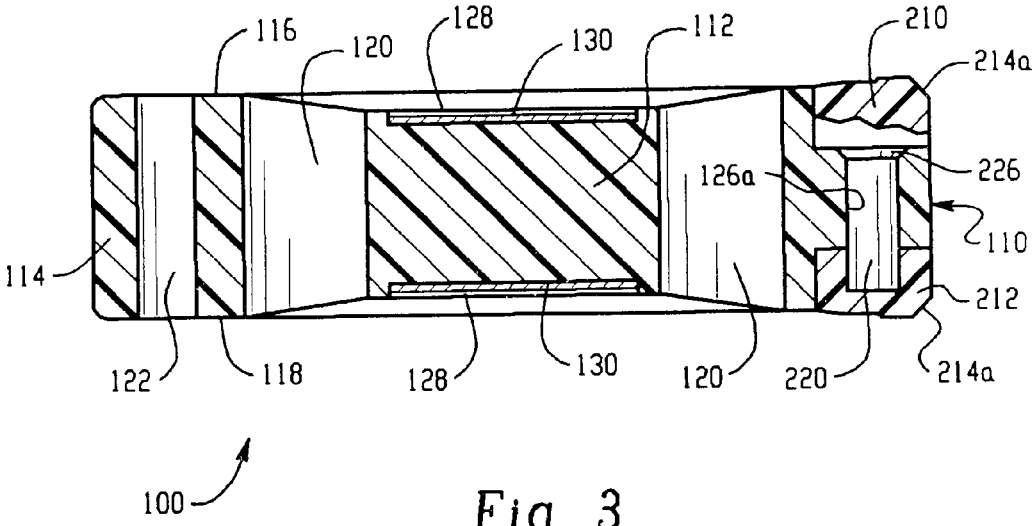
FIG. 3 is a cross-sectional side elevation view of the street hockey puck shown in FIG. 2B taken along section line A—A.
Figure 4:
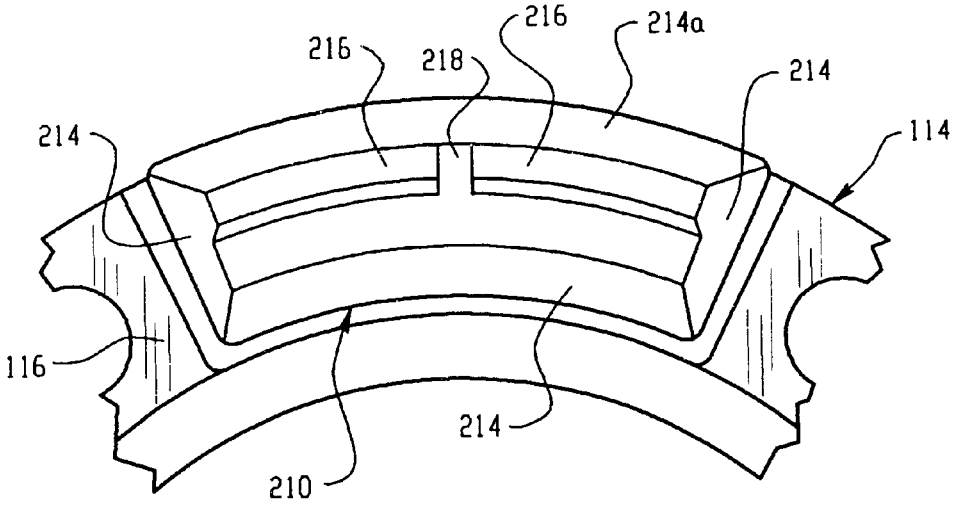
FIG. 4 is a partial top view of a street hockey puck with a skid assembly installed therein in accordance with aspect of the present invention.
Figure 5:
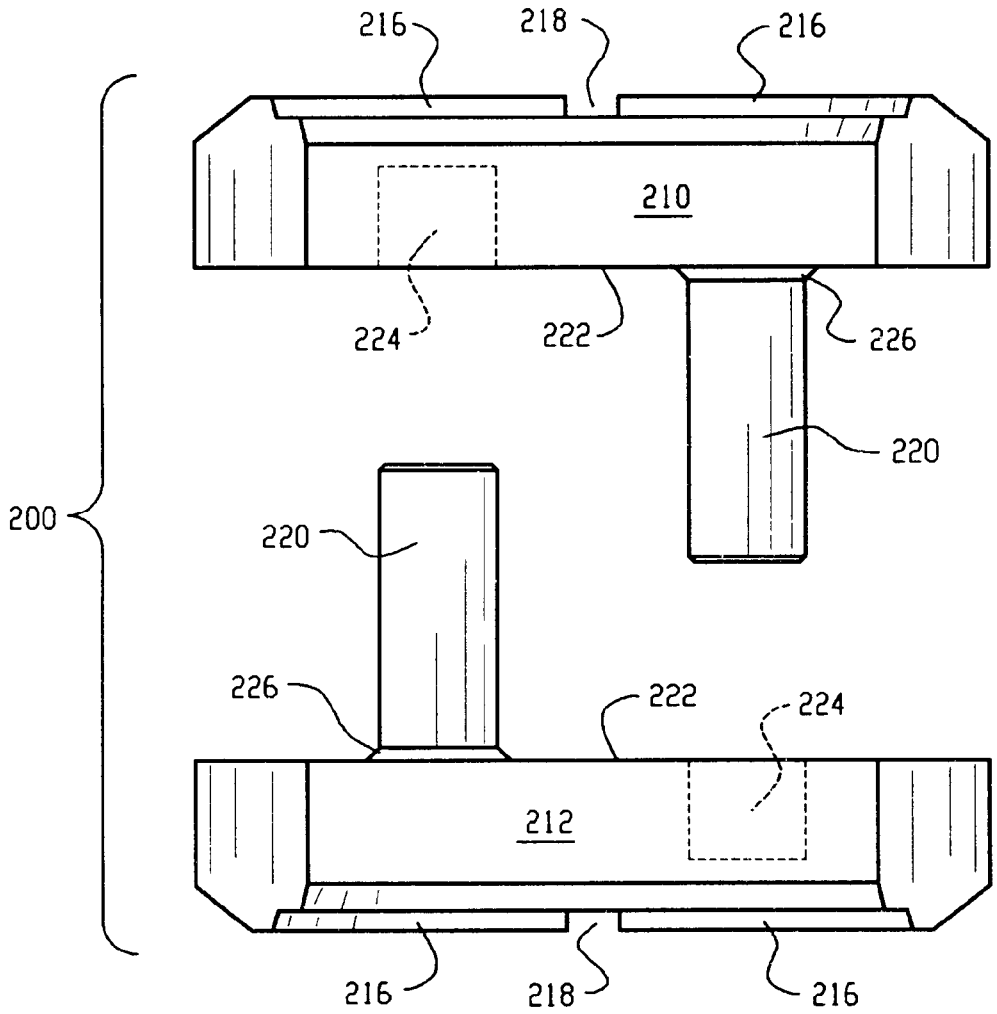
FIG. 5 is a side view of the skid assembly in FIG. 4 shown uninstalled and blow apart.
Figure 6:
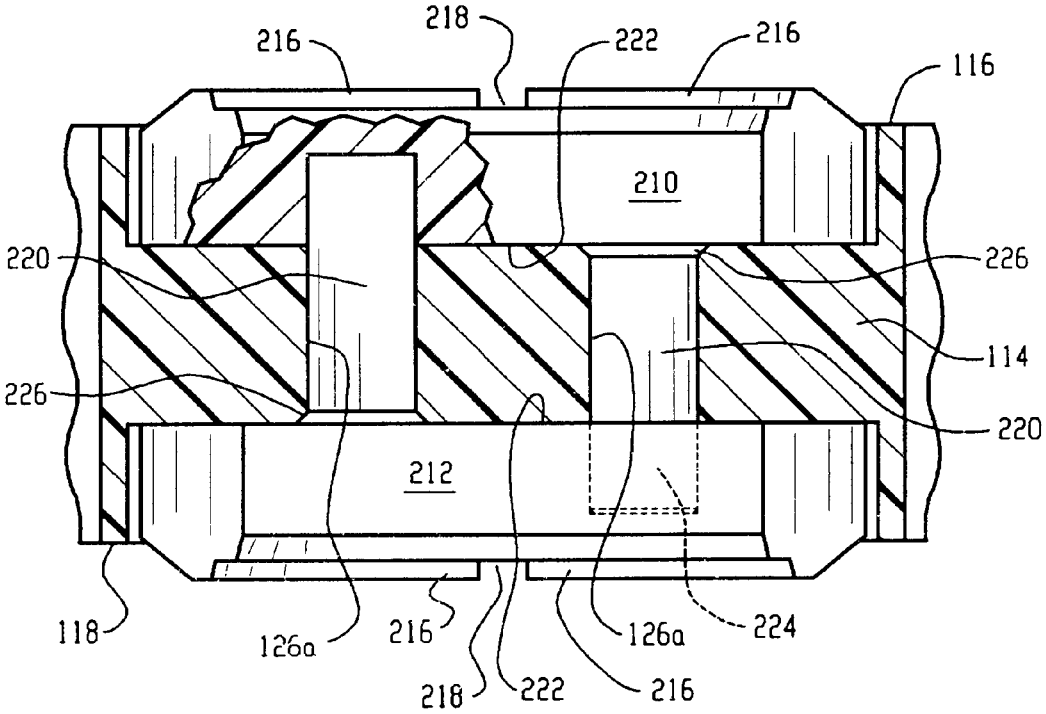
FIG. 6 is a partial side view of the street hockey puck shown in FIG. 4; and, FIG. 7 is a cross-sectional side elevation view of a street hockey puck having a hub which holds a freely rotatable bearing in accordance with aspects of the present invention.

With reference to FIGS. 4 through 6 and continuing reference to FIGS. 2A, 2B, and 3, a plurality of skid assemblies 200 are installed and/or disposed around the outer periphery of the main body 110 on the annular outer ring 114. Again, for uniformity of performance, the skid assemblies 200 are preferably angularly disposed in equal intervals. Each skid assembly 200 includes opposing first and second glides, runners, or skids 210 and 212 which are received in recesses 124 (best seen in FIGS. 2A and 2B) that are formed to accept the same. As best seen in FIGS. 3 and 6, the skids 210 and 212 have profiles that protrude beyond or otherwise sit proud of the top and bottom sides 116 and 118 of the main body 110, respectively. In this manner then, the street hockey puck 100 glides or slides across the rough planar playing surface on the skids 210 or 212 which contact the playing surface and keep the main body 110 raised therefrom.

As best seen in FIG. 3, the skids 210 and 212 also protrude radially slightly past the outer circumference or periphery of the main body 110. Therefore, in the event that the street hockey puck 100 is lifted or flip-up onto its side, the main body 110 remains raised from the playing surface.

For reduced friction, faster and smoother play, and extended life, the skids 210 and 212 are preferably molded or otherwise formed from a suitable low coefficient of friction hard material, such as, e.g., nylon, nylon 66, Vydyne®, Zytel®, etc.

Alternately, more or less skid assemblies 200 are employed. However, employing too many skid assemblies 200 tends to reduce the spacing therebetween. As the skid assemblies 200 are rigid, filling up too much of the outer circumference or periphery with skid assemblies 200 undesirably takes away from the flexibility of the annular outer ring 114. On the other hand, too few skid assemblies 200 leaves too much space therebetween where the main body 110 can undesirably catch or snag on the playing surface. Moreover, using too few skid assemblies 200 and lengthening them circumferentially is also undesirable insomuch as longer skids 210 and 212 tend to crack and break more readily under the hard impacts imparted to the street hockey puck 100. Accordingly, 5 skid assemblies 200 is preferred.

In any event, beveled edges 214 and 214*a* on the skids 210 and 212 are employed to reduce the likelihood of the skids 210 and 212 getting hung-up or caught on the rough surface or cracks in the playing surface. This promotes smoother sliding of the street hockey puck 100 thereby enhancing its ice hockey feel and performance. In addition, the beveled edges 214*a* at the circumference or outer periphery of the street hockey puck 100 help direct the street hockey puck 100 back to a flat orientation with respect to the playing surface when it has been flipped or lifted up onto its side. Moreover, the beveled edge 214*a* eliminates an otherwise sharp corner or edge thereby reducing potential injuries caused by the same.

In an alternate embodiment, one or more of the beveled edges 214 and 214*a* are rounded over with a radius instead of beveled. Regarding edges 214*a,* the rounding over with a radius again promotes tipping or tilting over of the street hockey puck 100 from its side back to the desired flat orientation with respect to the playing surface.

As best seen in FIGS. 5 and 6, the profiles of the skids 210 and 212 include protruding portions or ridges 216 defining a gap or groove 218 therebetween. In a preferred embodiment, the ridges 216 extend in arcs concentric with a central axis of the main body 110, and the groove 218 extends in a radial direction with respect to the central axis of the main body 110. Alternately, other configurations are employed. In any event, however, an amount of wearing of the skids 210 and 212 is readily ascertainable from measuring or otherwise observing the depth of the groove 218. That is to say, with use, the ridges 216 gradually wear away as a result of the frictional contact with the playing surface. Eventually, with enough use, the ridges 216 wear flush with the groove 218 therebetween indicating its time to replace the affected skid 210 or 212.

The skid assemblies 200 are installed or otherwise secured to the street hockey puck 100 by interconnecting the opposing skids 210 and 212 together on opposite sides of the main body 110 via pins 220 which extend longitudinally through optionally countersunk bores 126 in the recesses 124 located around the annular outer ring 114 of the main body 110. The pins 220 have a proximal end where they meet and/or connect with the base 222 of their respective skids 210 and 212, and a distal end opposite the proximal end. Each of the skids 210 and 212 also include a pin receiving recess 224 molded, cut, or otherwise formed in the base 222 of the skids 210 and 212. The pin receiving recess 224 of the first skid 210 receives therein the distal end of the pin 220 extending from the second skid 212, and the pin receiving recess 210 of the second skid 212 receives therein the distal end of the pin 220 extending from the first skid 210.

In this manner then, the distal end of the pin 220 extending from the first skid 210 extends into the second skid 212 past the proximal end of the pin 220 extending from the second skid 212. Likewise, the distal end of the pin 220 extending from the second skid 212 extends into the first skid 210 past the proximal end of the pin 220 extending from the first skid 210. The pins 220 are fixed or otherwise secured within the pin receiving recesses 224 optionally via glue, adhesives, sonic welding, pressure fits, friction fits or the like. With this configuration, no fragile housings extending from the base 222 of the skids 210 and 212 are employed to receive the pins 220. Consequently, adjacent the pins 220 are inner walls 126*a* of the bores 126 through which the pins 220 extend.

Alternately, the pins 220 are integrally formed or separately affixed to their respective skids 210 and 212. In either case, reinforcing collars 226 located where the pins 220 meet the skids' bases 222 are preferably employed to strengthen the junction. The optional countersunk portion 126*b* of the bores 126 is made to accept the reinforcing collar 226 of the pins 220 such that the base 222 of the skids 210 and 212 rest flat or flush in the recess 124.

In another alternate embodiment, more or less then two pins 220 are used to interconnect the skids 210 and 212 depending on the size and desired strength of the skid assemblies 200. Additionally, all the pins 220 optionally extend from one of the skids 210 or 212 while the pin receiving recesses 224 are all in the other, or some combination thereof so long as opposing pins 220 and pin receiving recesses 224 match up.

Continuing on then, with particular reference to FIG. 3, in a preferred embodiment, the center hub 112 includes a central cavity 128 on one or both sides thereof. The central cavity 128 is preferably sized to hold a thin standard, placard, emblem, token, or like inserts 130 having indicia, such as, e.g., a team, company, or like logo or name, printed or otherwise depicted thereon. So that the inserts 130 do not interfere with the performance of the street hockey puck 100 as is traverses the playing surface, the central cavity 128 is recessed enough so that the inserts 130 housed therein do not extend or protrude beyond the top or bottom sides 116 or 118 of the main body 110.

Figure 7:
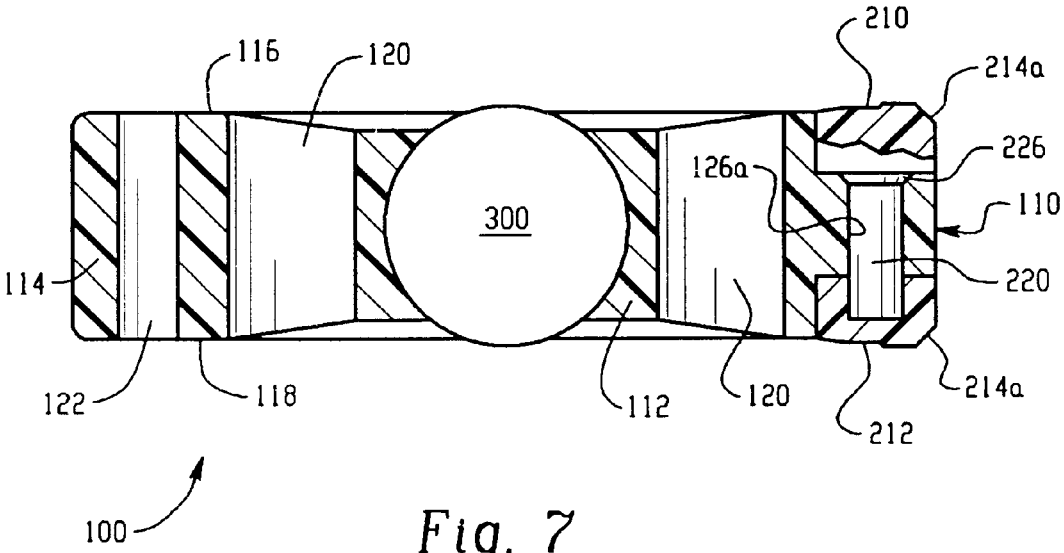

With particular reference to FIG. 7, in an alternate embodiment of the present invention, the cylindrical center hub 112 holds a freely rotatable spherical bearing 300 having an outer surface which sits proud of the top and bottom sides 116 and 180 of the main body 110. Alternately, multiple smaller bearings or wheels, spherical, cylindrical, disk shaped, or otherwise, are held on one or both sides of the center hub 112. In any event, in this embodiment, the center hub 112 of the main body 110 rides along the playing surface upon these bearings or wheels such that the puck's movement is facilitate thereby.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. A street hockey puck comprising:

a main body having opposing top and bottom sides and an outer periphery; and, a plurality of skid assemblies disposed around said outer periphery of the main body, wherein said skid assemblies each include opposing first and second skids having profiles that sit proud of the top and bottom sides of the main body, respectively, said first and second skids each including:

a pin which extends longitudinally through the main body, said pin having a distal end and a proximal end; and, a pin receiving recess, wherein the pin receiving recess of the first skid receives therein the distal end of the pin extending from the second skid, and the pin receiving recess of the second skid receives therein the distal end of the pin extending from the first skid;

wherein the distal end of the pin extending from the first skid extends past the proximal end of the pin extending from the second skid, and the distal end of the pin extending from the second skid extends past the proximal end of the pin extending from the first skid.

2. A street hockey puck comprising:

a main body having opposing top and bottom sides; and, at least one skid assembly disposed on the main body, wherein said skid assembly includes:

opposing first and second skids having profiles that sit proud of the top and bottom sides of the main body; and, a pin which extends from one of the first and second skids through the main body into a pin receiving recess in the other of the first and second skids to thereby secure the skid assembly to the main body;

wherein the first and second skids each include protruding portions defining a groove therebetween.

3. The street hockey puck according to claim 2, wherein the groove extends in a radial direction with respect to a central axis of the main body.

4. The street hockey puck according to claim 2, wherein said groove has a depth and an amount of wearing of the first and second skids is readily ascertainable from observing the depth of the groove.

5. The street hockey puck according to claim 1, wherein the pins are solid.

6. The street hockey puck according to claim 1, wherein the main body includes longitudinal bores through which the pins extend, said bores having inner walls to which the pins extending therethrough are adjacent.

7. A street hockey puck comprising:

a main body having opposing top and bottom sides and a longitudinal bore therethrough; and, a skid assembly including;

opposing first and second skids having profiles that sit proud of the top and bottom sides;

a pin extending longitudinally from the first skid, said pin being longer than the longitudinal bore; and, a pin receiving recess in the second skid, wherein the pin passes through the longitudinal bore in the main body and is received in the pin receiving recess to thereby secure the skid assembly to the main body.

8. The street hockey puck according to claim 7, wherein the pin is adjacent an inner wall of the longitudinal bore.

9. The street hockey puck according to claim 7, wherein the skid assemblies include wear indication means for indicating an amount of wear on the skid assemblies.

10. The street hockey puck according to claim 7, wherein said main body includes:

a cylindrical center hubs;

a deformable annular outer ring which is concentric with the cylindrical center hub, said deformable annular outer ring defining an outer periphery of the main body; and, a plurality of shock absorbing mechanical linkages connecting the deformable annular outer ring to the cylindrical center hub, said mechanical linkages disposed angularly about the cylindrical center hub.

11. The street hockey puck according to claim 10, wherein the mechanical linkages comprise collapsible hollow cylindrical members connecting the deformable annular outer ring to the cylindrical center hub.

12. The street hockey puck according to claim 10, wherein the mechanical linkages comprise flexible arcing members extending from the cylindrical center hub to the deformable annular outer ring, at least one of said arcing members having a direction of curvature different from another one of said arcing members.

13. The street hockey puck according to claim 12, wherein adjacent arcing members have opposing directions of curvature.

14. The street hockey puck according to claim 10, wherein the deformable annular outer ring has a plurality of relief holes disposed therein, said relief holes extending longitudinally from the top side to the bottom side of the main body.

15. The street hockey puck according to claim 10, wherein the main body further includes at least one recessed cavity in the central hub.

16. The street hockey puck according to claim 10, wherein the cylindrical center hub holds a freely rotatable bearing therein, said bearing facilitating movement of the street hockey puck across a playing surface.

17. A hockey puck comprising:

a main body having opposing top and bottom sides and a bore therethrough; and, a skid assembly including;

opposing first and second skids having profiles that sit proud of the top and bottom sides of the main body; and, a solid pin which extends from one of the first and second skids through the bore into a pin receiving recess in the other of the first and second skids to thereby secure the skid assembly to the main body;

wherein the solid pin is adjacent to an inner wall of the bore through which the solid pin extends.

18. A skid assembly for a puck having opposing top and bottom sides and a bore therethrough, said skid assembly comprising:

opposing first and second skids having profiles that sit proud of the top and bottom sides;

a pin extending from one of the first and second skids, said pin being longer than the bore; and, a pin receiving recess in the other of the first and second skids;

wherein the pin passes through the bore and is received in the pin receiving recess to thereby secure the skid assembly to the puck.

19. The skid assembly of claim 9, further comprising:

wear indication means for indicating an amount of wear on the skid assembly.

20. The skid assembly of claim 19, wherein the pin is solid.

* * * * *